United States Patent [19]

Larson

[11] 4,285,786

[45] Aug. 25, 1981

[54] APPARATUS AND METHOD OF MONITORING TEMPERATURE IN A MULTI-CELL ELECTROLYZER

[75] Inventor: Eric H. Larson, Marcellus, N.Y.

[73] Assignee: Allied Chemical Corporation, Morris Township, Morris County, N.J.

[21] Appl. No.: 148,344

[22] Filed: May 9, 1980

[51] Int. Cl.[3] ..... C25B 1/34; C25B 1/02; C25B 9/00

[52] U.S. Cl. ..... 204/98; 204/128; 204/129; 204/255; 204/256; 204/257; 204/258

[58] Field of Search ..... 204/98, 128–129, 204/255–258

[56] References Cited

U.S. PATENT DOCUMENTS

| | | | |
|---|---|---|---|
| 3,902,985 | 9/1975 | Raetzsch et al. | 204/268 |
| 4,057,474 | 11/1977 | Kurtz et al. | 204/98 |
| 4,181,587 | 1/1980 | Kurtz | 204/98 |
| 4,197,179 | 4/1980 | Ezzell et al. | 204/98 |

Foreign Patent Documents

| | | |
|---|---|---|
| 955349 | United Kingdom | 2/1961 |
| 1218268 | United Kingdom | 1/1971 |
| 1305212 | United Kingdom | 1/1973 |
| 1487995 | United Kingdom | 10/1977 |
| 1491937 | United Kingdom | 11/1977 |
| 11488 | European Pat. Orig. | 5/1980 |

OTHER PUBLICATIONS

"Hypochlorate Generator For Treatment of Combined Sewer Overflows" for E.P.A. by Ionics Inc., 3/1972.

*Primary Examiner*—R. L. Andrews
*Attorney, Agent, or Firm*—Thomas D. Hoffman

[57] ABSTRACT

An apparatus and method of monitoring temperature in a multicell electrolyzer used to produce a gaseous product from a liquid phase electrolyte by placing a single temperature sensing means in the common product collection means is disclosed.

16 Claims, 5 Drawing Figures

APPARATUS AND METHOD OF MONITORING TEMPERATURE IN A MULTI-CELL ELECTROLYZER

DESCRIPTION

BACKGROUND OF THE INVENTION

The present invention relates to an apparatus and method of monitoring temperature in an electrolyzer. More particularly, the present invention relates to an apparatus and method of monitoring temperature in a multi-cell electrolyzer used to produce a gaseous product from a liquid electrolyte phase.

Halogen gas and alkali metal hydroxide solution are commonly produced from brine in multi-cell electrolyzers. The operating variables of multi-cell electrolyzers should be maintained within certain limits. One of the more important of these parameters is the operating cell temperature, especially for electrolyzers employing permselective membranes. The service life time of these membranes is significantly reduced by higher than normal operating temperatures. While it is possible to employ temperature sensing means in each individual cell of a multi-cell electrolyzer, this approach would require a significant capital investment and a stringent maintenance program.

Accordingly, it is one object of the present invention to provide an apparatus and method for the monitoring of temperature in a multi-cell electrolyzer with the installation of a minimum of temperature sensing equipment.

SUMMARY OF THE INVENTION

In accordance with the present invention there is provided an improved apparatus for producing a gaseous product stream by electrochemical conversion of a liquid phase electrolyte in a bank of two or more electrolytic cells, each cell comprising a cell body having an anode and a cathode; an inlet means; an outlet means for a gaseous product stream and for at least depleted liquid phase electrolyte; a common collection means for the gaseous product stream; and, a common collection means for at least the depleted liquid phase electrolyte, wherein the improvement comprises (a) a single first temperature sensing means positioned in the common collection means for the gaseous product stream; and (b) means to monitor an output signal from said single first sensing means.

In accordance with the present invention there is further provided an improved process for making halogen gas and an alkali metal hydroxide by electrolysis of aqueous alkali matal halide brine in a bank of two or more electrolytic cells, each cell containing an anode and a cathode and being separated into an anode compartment and a cathode compartment, wherein (a) the halide brine is introduced into an anode compartment; (b) halogen gas produced at an anode is withdrawn from the cathode compartments by a common halogen gas collection means; (c) depleted halide brine is removed from the anode compartments through a common depleted brine collection means; (d) water or dilute alkali metal hydroxide is fed to a cathode compartment; (e) alkali metal hydroxide is withdrawn through a common alkali hydroxide collection means from the cathode compartments; and (f) hydrogen gas produced at a cathode is withdrawn through a common hydrogen gas collection means. The improvement comprises monitoring temperature in the bank by monitoring a output signal of a single temperature sensing means placed in the common gas collection means for hydrogen or halogen gas.

DETAILED DESCRIPTION OF THE INVENTION

In its broadest embodiment the present invention provides a simple and inexpensive apparatus and method to monitor temperature in each cell in a multi-cell electrolyzer used for electrochemical conversion of a liquid phase electrolyte to produce a gaseous product stream by monitoring a output signal of a single first temperature sensing means placed in a common gas collection means, i.e., common header for a gaseous product stream, in which the products of the individual cells of the multi-cell electrolyzer are collected. In a preferred embodiment of the apparatus and method of the present invention a single second temperature sensing means was also placed in the common collection means for depleted liquid phase electrolyte, e.g., depleted brine, or an aqueous product stream and a temperature excursion, i.e., a decrease or increase in the desired temperature was monitored in each cell of a multi-cell electrolyzer by measuring the difference in the output signals of the first and second temperature sensing means.

Figure 1:
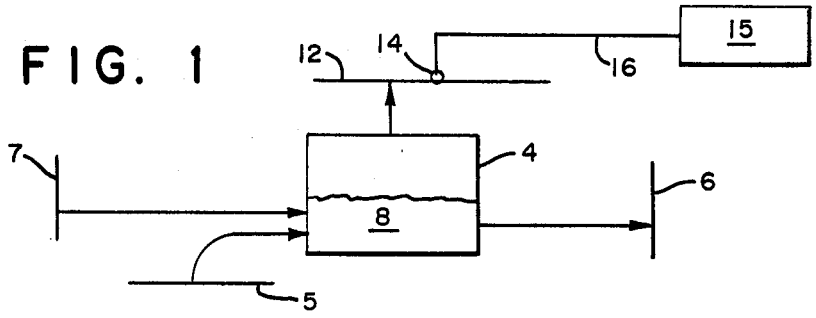
FIG. 1 illustrates a single temperature sensing means positioned in the common collection means for gaseous product stream produced in an electrolyzer containing a liquid phase electrolyte.

The invention is better understood by reference to the drawings. FIG. 1 illustrates a broad aspect of the present invention for monitoring temperature excursions in a bank of two or more electrolytic cells employed for the electrochemical conversion of a liquid phase electrolyte to produce a gaseous product stream; the depleted liquid phase electrolyte and gaseous product are removed via outlet means and transferred to common collection means. Each cell comprises a cell body 4 having anode and cathode (not shown for simplicity) and containing a liquid phase electrolyte 8. The liquid phase electrolyte may conveniently be comprised of one or more reactants which are introduced into cell body 4 via inlets and, common headers 5 and 7. Depleted liquid phase electrolyte which may also contain a liquid product is removed from the cell via outlet means and common collection means 6. The gaseous product stream is withdrawn from the cell via outlet means and common gaseous product stream collection means 12. A single first temperature sensing means 14 is placed in common gaseous product stream collection means 12.

Electrical means 16 connects first temperature sensing means 14 to controller 15.

In a preferred embodiment of the present invention, a single temperature sensing means (not shown) is placed in the common collection means 6 for the depleted liquid phase electrolyte. Electrical connecting means (not shown) connects the second temperature sensing means 12 to controller 15. A difference between the output signals of the first and second temperature sensing means can conveniently be measured by controller 15. By measuring a difference in the output signals of two temperature sensors placed in a common collection means for a gaseous product stream and the common collection means for the depleted liquid phase electrolyte or alternately a liquid product, in accordance with the present invention, temperature in the entire bank of cells, during the start up and operation of the electrochemical reaction can be more accurately monitored.

The controller 15 can conveniently be equipped with alarms or relays. Thus if the signal output from temperature sensing means which is monitored by temperature controller, shows a temperature outside of a predetermined acceptably safe range, the alarm may sound or the relay may be triggered to shut down the whole bank.

The present invention is applicable in a wide range of electrochemical conversions of a liquid phase electrolyte to produce gaseous product stream; see for example, the electrolytic production of alkali metal halates, such as sodium chlorate or sodium bromate which is disclosed in U.S. Pat. No. 3,902,985, issued Sept. 2, 1975 (Raetsch et al. assigned to PPG Industries Inc). Alkali metal halide brine is fed via a common header to an end of each cell in a plurality of bipolar electrolytic cells. Hydrogen gas is evolved in the cathode; product alkali metal hydroxide and product chlorine come into contact to produce hypochlorite which is oxidized to chlorate and withdrawn from the cell. Generally, the depleted brine containing alkali metal hypochlorite is feed to the next cell in series flow.

Figure 2:
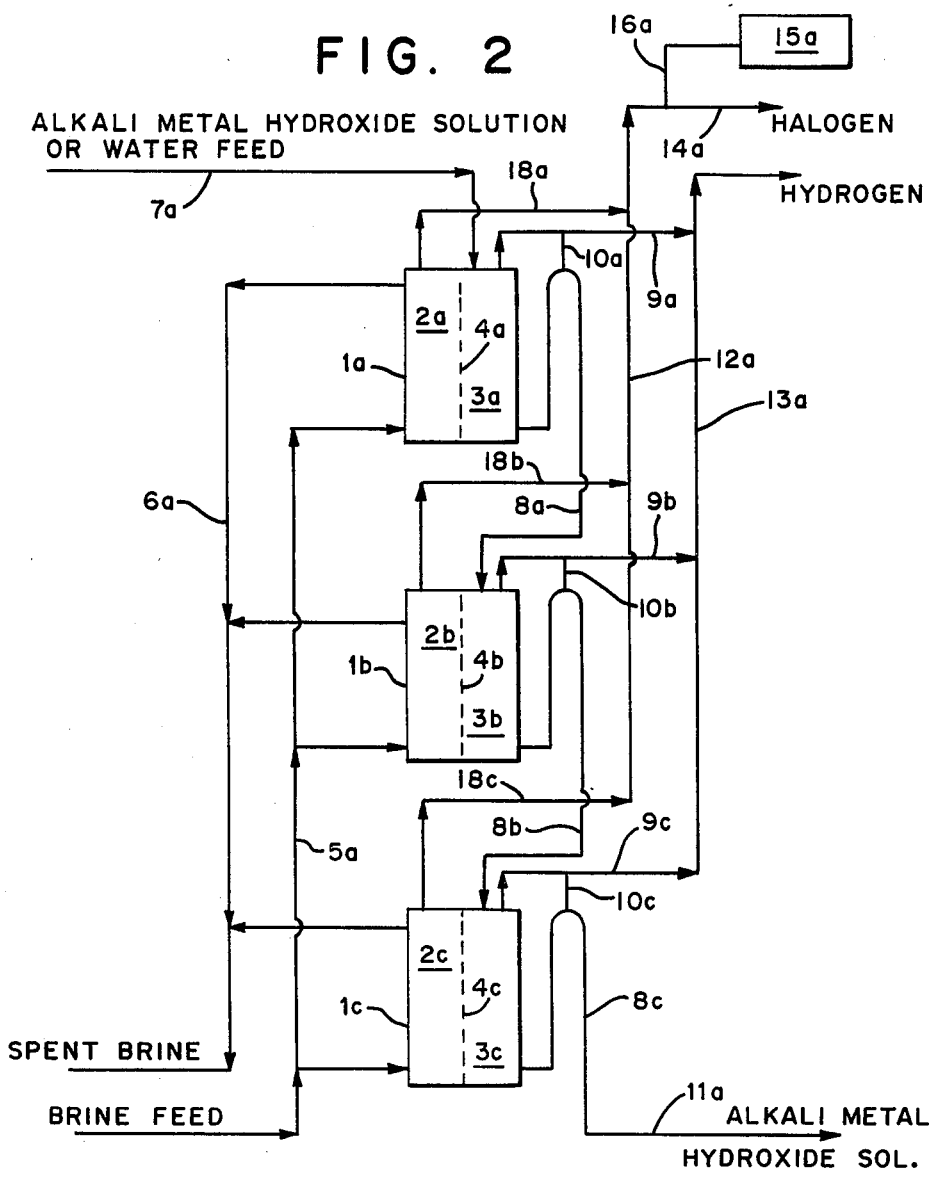
FIG. 2 illustrates a single temperature sensing device employed in the common gas collector of a bank of three cells connected in series catholyte flow.

FIG. 2 illustrates another broad aspect of the present invention wherein a single temperature sensing means 14*a* is positioned in the common halogen gas collection means 12*a* for a bank of three cells for the electrolysis of alkali metal halide brine employing series catholyte flow. There is shown in FIG. 2 a bank comprising three membrane cells 1*a*, 1*b*, and 1*c* each having an anolyte compartment 2*a*, 2*b*, and 2*c* and a catholyte compartment 3*a*, 3*b*, and 3*c*, separated by a diaphragm or cation permselective membrane, preferably cation permselective membranes 4*a*, 4*b*, and 4*c*. Anodes and cathodes are not shown for the sake of simplicity . Brines of aqueous alkali metal halide solution are fed to the anode compartment of each cell by means of common header 5*a*; spent brine is discharged from the anode compartment of each cell through common depleted brine collection means into common header 6*a*. Water or dilute alkali metal hydroxide solution, preferably water, is fed by means of line 7*a* to cathode compartment 3*a* of the first cell 1*a* in the bank only. Catholyte is then serially passed form cell to cell by means of gravity; catholyte from cathode compartment 3*a* of the first cell in the series flows by means of gravity through line 8*a* into cathode compartment 3*b* of the second cell in the series, then from cathode compartment 3*b* to cathode compartment 3*c* of the third cell in the series, to be withdrawn therefrom as alkaline metal kydroxide solution product through line 8*c* to final alkali hydroxide product collection means 11. The level of catholyte in each of the three catholyte compartments is maintained by seal loops 10*a*, 10*b* and 10*c*. The temperature sensing means 14*a* positioned in the common halogen gas collection means 12*a* is connected by an electrical means or wire 16*a* to temperature control 15*a*. If the signal output from temperature sensing means 14*a* which is monitored by temperature controller 15*a*, shows a temperature excursion, an alarm may sound or a relay may be triggered to shut down the whole bank. In an alternate embodiment of the present invention a single temperature sensing means was placed in the common hydrogen gas collection means 13*a*.

In another embodiment of the present invention employed in a electrolyzer as described in FIG. 2, a first single temperature sensing menas was placed in the common collection means for hydrogen gas (header 13*a*) or for halogen gas (header 12*a*) and a second single temperature sensing means was placed in header 6*a* for depleted brine or in the header 11*a* for the alkali metal hydroxide.

In a preferred embodiment of the present invention, a first single temperature sensing means was placed in common collection means 13*a* for hydrogen gas and a second single temperature sensing means was placed in common collection means 11*a* for alkali metal hydroxide. In an alternate preferred embodiment of the present invention, a first single temperature means was placed in header 12*a* for halogen gas and a second single temperature sensing means was placed in header 6*a* for depleted brine. It was discovered that by operating in accordance with either of these two preferred embodiments, i.e., by monitoring the temperature of the gas and liquid product streams from the same compartments of cells employing a permselective membrane, preferably a cation permselective membrane, the monitoring of temperature for one whole bank of cells was more reliable. However, when the present invention is employed in a cell shown in FIG. 1 or in a diaphram cell, e.g., as described in FIG. 2, placement of the first and second temperature sensing means was not found as critical, e.g. when a first single temperature sensing means was placed in the common header for halogen gas, the second single temperature sensing means could conveniently placed in the common header for depleted brine or in the header for alkali metal hydroxide.

Of course, it is obvious to one of ordinary skill in the art that pumps could be used to transfer the catholyte from one cell to a certain cell in the bank. It is also contemplated within the scope of the present invention that four separate temperature sensing means be positioned in each of the common product collection means i.e., for halogen gas in 12*a*, for hydrogen gas in 13*a*, for the depleted brine in 6*a* and for the final alkali metal hydroxide product collection means in 11*a*.

Further, the present invention is not limited to electrolyzers employing series catholyte flow; the individual cells can also be connected in parallel for parallel catholyte flow or parallel anolyte flow and series catholyte flow or series anolyte flow and countercurrent, series catholyte flow. The only requirement is that the products from each cell be collected by a common headers or common product collection means.

Figure 3:
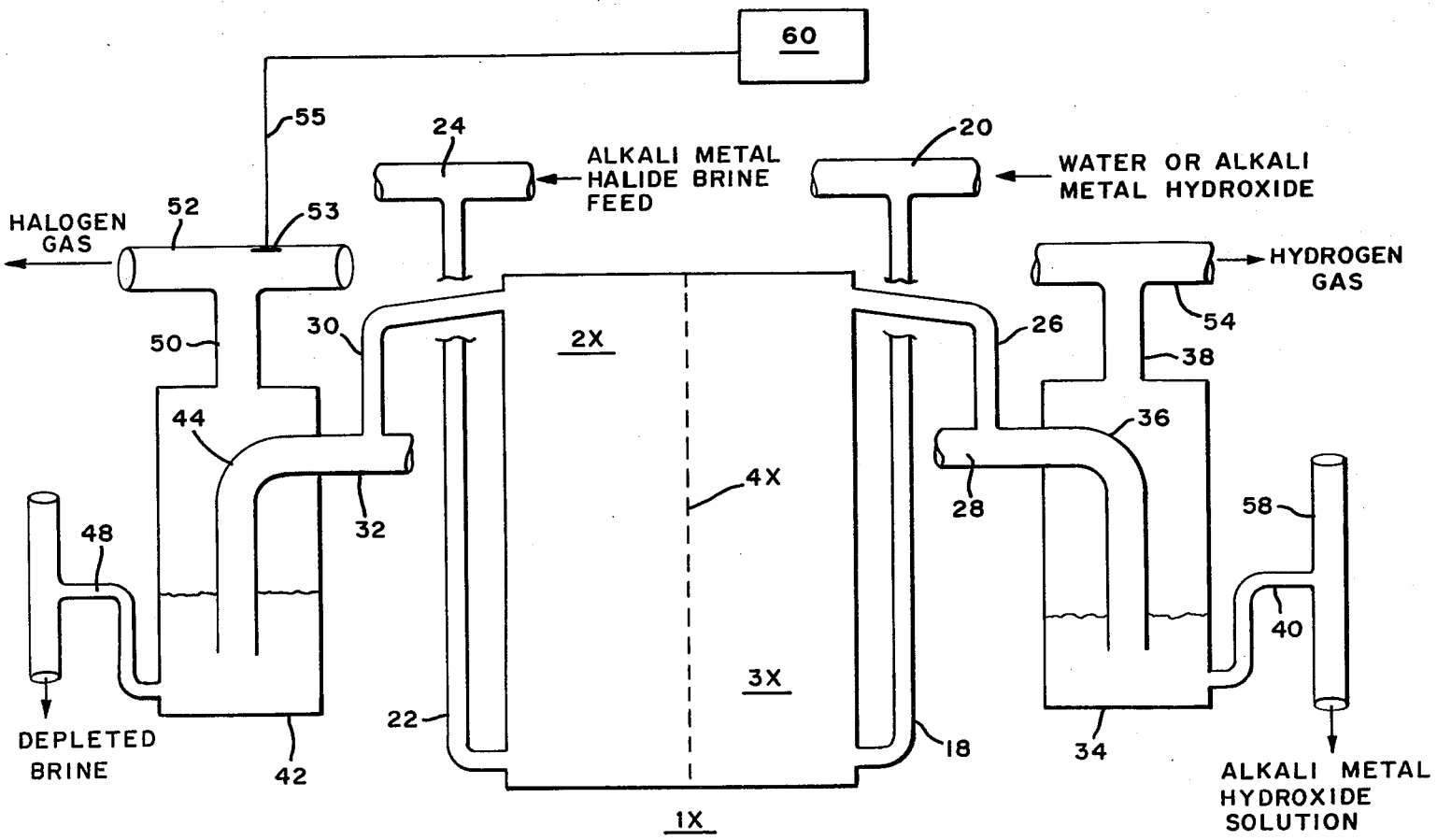
FIG. 3 illustrates another embodiment of the present invention wherein a single temperature sensing devices is employed in a unit cell having two phase flow.

FIG. 3 illustrates temperature monitoring in a unit cell employing two phase flow; the liquid and gaseous products are removed from each cell via a common outlet means and then separated and transferred to individual common headers. The unit cell 1*x* has an anode compartment 2*x* and a cathode compartment 3*x* separated by a diaphragm or permselective membrane, preferably cation permselective membrane 4*x*. Alkaline metal chloride brine is introduced into the anode compartment via header 24 and line 22, and water or dilute alkali metal hydroxide solution is introduced into the cathode compartment via header 20 and line 18. Anodes and cathodes are not shown for the sake of simplicity . Depleted brine and halogen gas are withdrawn from the anode compartment through line 30, two phase flow collection header 32 and leg 44 to seal pot 42 wherein the liquid and gas separates, halogen gas being removed via line 50 and common halogen gas collection means 52 and, the brine through overflow line 48 to outlet or common header 56. Similarly, on the cathode side, alkali metal hydroxide catholyte and halogen gas are withdrawn via line 26, two phase flow collection header 28 and leg 36 to seal pot 34 from whence hydrogen gas is removed via line 38 and common hydrogen gas collection means 54 and, catholyte via overflow line 40 to common alkali metal hydroxide collection means 58. In the broadest aspect of the present invention a single temperature sensing means 53 is positioned in the common gas collection means for halogen 52 or hydrogen gas 54; electrical means would connect temperature sensing means to a controller.

Figure 4:
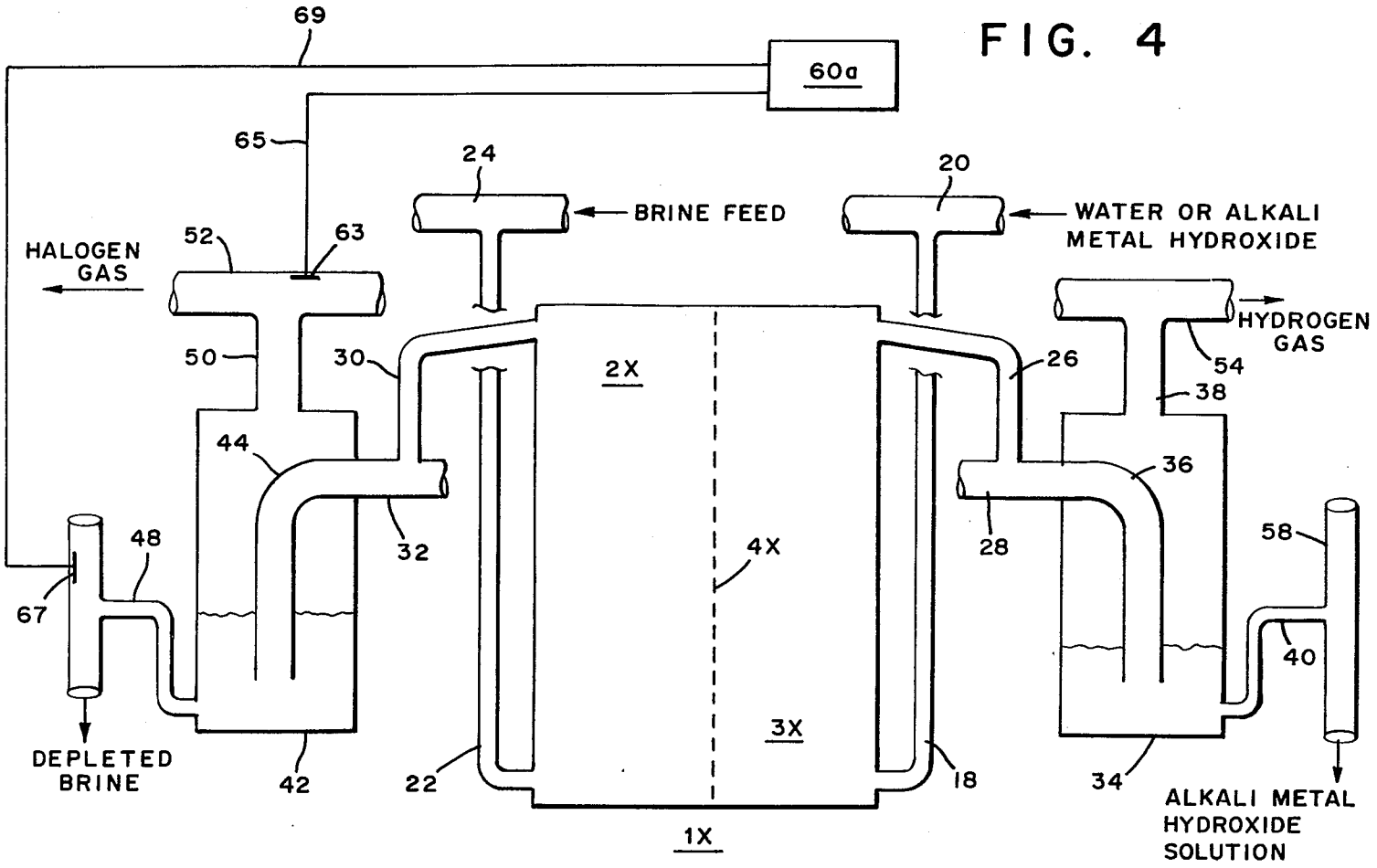
FIG. 4 illustrates another preferred embodiment of the present invention wherein two temperature sensing devices are employed in a unit cell having two phase flow.
Figure 5:
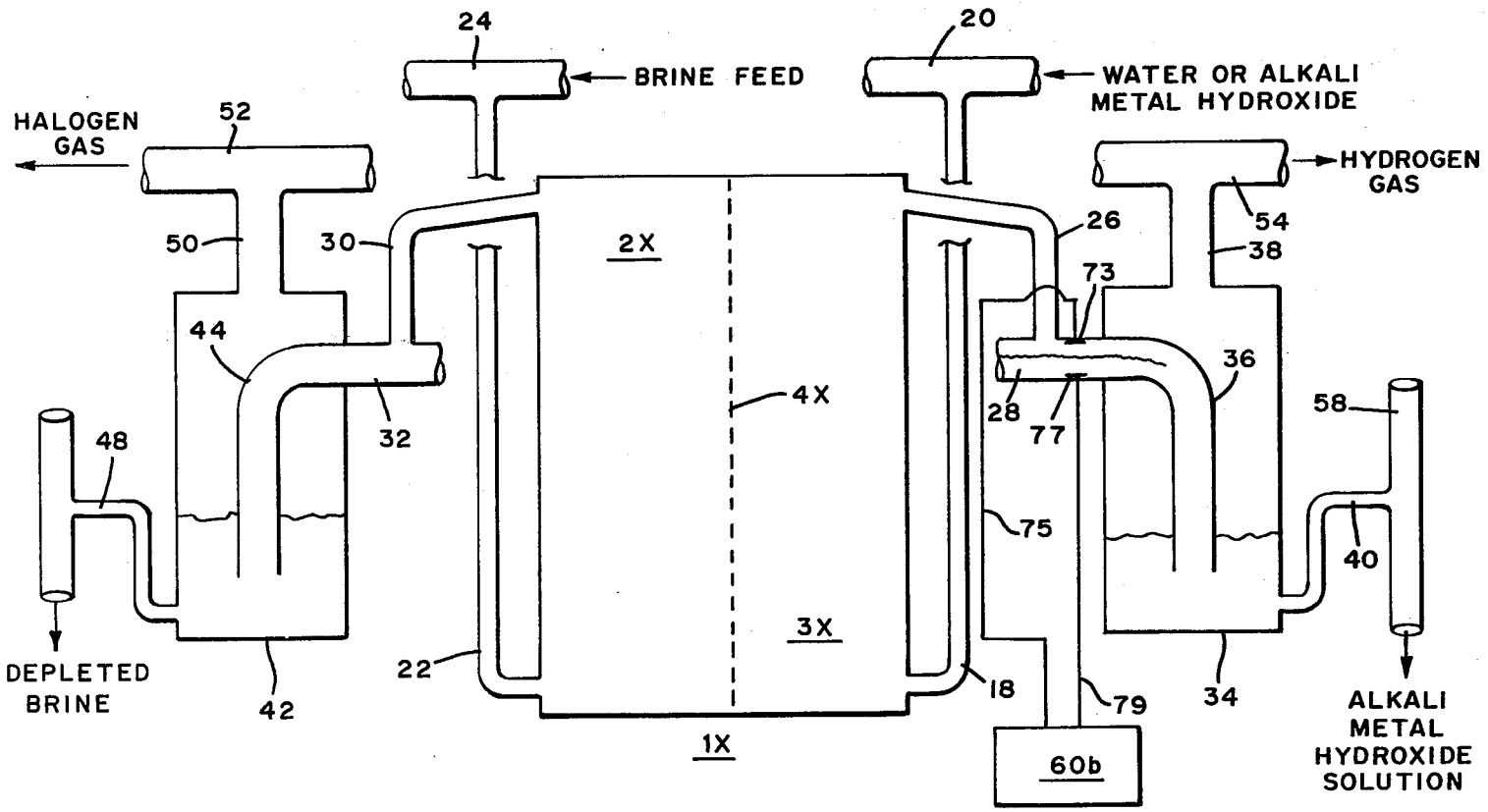
FIG. 5 illustrates another preferred embodiment of the present invention wherein two temperature sensing devices are employed in a two phase flow collection header.

In FIG. 4 there is shown another preferred embodiment of the present invention; a single temperature sensing means 63 is placed in the halogen gas collection means 52 and another temperature sensing means 67 is placed in the common alkali metal hydroxide collection means 48. In FIG. 5 there is shown an alternate preferred embodiment of the present invention; a first temperature sensing means 73 is placed in the gas phase of a two phase flow collection header 28 and; a second temperature sensing means 77 is placed in the liquid phase of collection header 28. Of course, the diameter of header 28 must be such to allow for separate liquid and gaseous phases. Electrical means 75 and 79 connect the temperature sensors 73 and 77 to controller 60*b* which monitors the difference in the output signals of the two temperature sensing means.

While electrolyzers operate with diaphragms or permselective membranes the use of cation permselective membranes is preferred. However, the cation permselective membranes are more susceptible to damage caused by temperature changes when feed to the individual cell is interupted. Surprisingly, it was discovered in the course of the development of the present invention that by installation of a single temperature sensing means in the common headers or collection means for the gaseous products it was possible to detect a temperature excursion, i.e., temperature increases or decreases in an individual cell, even though a given electrolyzer may contain 50 or more unit cells. Temperature sensing means, for example, thermocouples may be of any convenient design and be constructed of any metals which can withstand the corrosive chemical environment in the common headers, or be conveniently enclosed in protective sleeves. In a preferred embodiment, two temperature controllers were interfaced with the thermocouples installed in the alkali metal hydroxide collection means and the common hydrogen gas collection means; the controllers monitor the difference in the output signals from these temperature sensors. In an alternate preferred embodiment the thermocouples were installed in the halogen gas and the depleted brine headers. Conveniently, the controllers are dual set point control units which are connected to alarms and to a electrical circuit breaker. During start-up of a multi-cell electrolyzer, the set points are 60° C. for the lower end and 90° C. for the upper end. When the electrolyzer reaches temperature equilibrium, the set points are 80° C. for the lower and 90° C. for the upper, preferably 85° for the lower and 88° C. for the upper point. A temperature excursion is detected as follows: an alarm sounds when the temperature exceeds the lower set point; and if the temperature exceeds the upper set point the electrolyzer will be shut down. The temperature controllers are also fail-safe in their operation such that if a thermo couple or temperature sensing means fails the electrolyzer will shut down and, if the line voltage to the controllers fails, the alarms will sound.

During start up of an electrolyzer used to produce alkali metal hydroxide and halogen gas, it is preferred to monitor the out-put signals of thermocouples inserted in each of the four product headers. Of course during operation at temperature equilibrium, i.e., 85°–88° C., monitoring of the difference between a temperature sensing means inserted in a common gaseous product collection means and another one placed in a common liquid product collection means is sufficient to monitor the temperature in the entire electrolyzer bank.

Cation permselective membranes for use in electrolytic cells from making alkali metal hydroxide solution and halogen gas for alkaline metal halide brine are well known to those skilled in the art and are commercially available, for example, from DuPont under the trademark Nafion. Commercially available permselective membranes are usually formed of fluorosulfonic acid resin which, in order to improve their physical strength may be laminated onto a woven mesh or fabric formed from halocarbon polymers, such as polytetrafluoroethylene, for example, polytetrafluoroethylene fabric. Fabric reinforcement also increases the dimensional stability of the membranes.

There are two distinct types of electrode arrangement which may be utilized in the operation of a bank of cells in accordance with the present invention, namely a bipolar arrangement and a monopolar arrangement. In a monopolar arrangement all of the cathodes of the bank of cells are connected to a common negative terminal, and all of the anodes are connected to a common positive terminal. In a bipolar assembly, all of the cells are connected electrically in series so that the cathode of each cell is connected directly to the anode of the succeeding cell except, of course, in the case of the first and the last cell in the bank. The advantage of reduced overall power consumption obtainable by employing series catholyte flow and in accordance with the present invention is no way affected by the type of electrical circuitry utilized. However, to minimize capital construction cost the bipolar electrode assembly is preferred since a bipolar assembly permits the greatest simplicity in mechanical and electrical construction of a compact cell bank.

Detailed design and construction of the apparatus for carrying out the present invention is within the skills of an ordinary skilled practioner versed in the art.

The apparatus and process of the present invention is particularly suited for making sodium and potassium hydroxide, chlorine and hydrogen gas from sodium or potassium chloride. However, the present invention is applicable to any electrochemical conversion of a liquid phase electrolyte to produce at least a gaseous product;

the scope of the present invention is thus limited only insofar as the details are recited in the appended claims.

What is claimed:

1. In a process for making halogen gas and alkali metal hydroxide by electrolysis of an aqueous alkali metal halide brine in a bank of two or more electrolytic cells, each cell containing an anode and a cathode and being separated into an anode compartment and a cathode compartment, wherein (a) the halide brine is introduced into an anode compartment; (b) halogen gas produced at an anode is withdrawn from the anode compartments by a common halogen gas collection means; (c) depleted halide brine is removed from the anode compartments through common depleted brine collection means; (d) water or dilute alkali metal hydroxide is fed to a cathode compartment; (e) alkali metal hydroxide is withdrawn through a common alkali metal hydroxide collection means from the cathode compartments; and (f) hydrogen gas produced at a cathode is withdrawn through a common hydrogen gas collection means, the improvement which comprises monitoring temperature in the bank by monitoring a output signal of a single temperature sensing means placed in the common gas collection means for hydrogen or halogen gas.

2. A process as described in claim 1 wherein the improvement further comprises feeding water or dilute alkali metal hydroxide solution to a cathode compartment of a preceding cell in the bank and withdrawing alkali metal hydroxide solution from the cathode compartment of one or more succeeding cells in the bank.

3. A process as described in claim 1 wherein the alkali metal halide is sodium chloride, the halogen gas is chlorine and the alkali metal hydroxide is an sodium hydroxide.

4. A process as described in claim 1 wherein a first single temperature sensing means is placed in the common hydrogen gas collection means.

5. A process as described in claim 4 which further comprises placing a second single temperature sensing means in the common alkali metal hydroxide collection means and monitoring the difference in the outputs of the two signals.

6. A process as described in claim 4 which further comprises placing a second single temperature sensing means in the outlet means for the depleted brine and monitoring the difference in the outputs of the two signals.

7. A process as described in claim 1 wherein a first single temperature sensing means is placed in the common halogen gas collection means.

8. A process as described in claim 7 which further comprises placing a second single temperature sensing means in the outlet means for the depleted brine and monitoring the difference in the outputs of the two signals.

9. A process as described in claim 7 which further comprises placing a second single temperature sensor means in the common alkali metal hydroxide collection means and monitoring the difference in the outputs of the two signals.

10. A process as described in claim 1 wherein the electrodes are bipolar.

11. A process as described in claim 1 wherein a diaphragm is interposed between the anode and cathode compartments.

12. A process as described in claim 1 wherein a cation permselective membrane is positioned between the anode and cathode compartments.

13. In an apparatus for producing a gaseous product stream by electrochemical conversion of a liquid phase electrolyte in a bank of two or more electrolytic cells, each cell comprising a cell body having an anode and a cathode; an inlet means; outlet means for a gaseous product and for at least depleted liquid phase electrolyte; a common collection means for gaseous product stream; and a common collection means for at least depleted liquid phase electrolyte; the improvement which comprises (a) a single first temperature sensing means positioned in the common collection means for gaseous product stream; and (b) means to monitor an output signal from said single first sensing means.

14. The apparatus as described in claim 13 wherein the improvement further comprises a single second temperature means positioned in the common collection means for the depleted liquid phase and means to measure a difference between the output signals of the first and second sensing means.

15. The apparatus as described in claim 13 wherein the improvement further comprises a diaphram or permselective membrane separating each cell into a cathode compartment and an anode compartment.

16. The apparatus as described in claim 13 wherein the anode and cathode are bipolar.

* * * * *